United States Patent [19]

Mossaides

[11] Patent Number: 4,509,043

[45] Date of Patent: Apr. 2, 1985

[54] METHOD AND APPARATUS FOR DISPLAYING IMAGES

[75] Inventor: Paula X. Mossaides, Canby, Oreg.

[73] Assignee: Tektronix, Inc., Beaverton, Oreg.

[21] Appl. No.: 367,659

[22] Filed: Apr. 12, 1982

[51] Int. Cl.[3] ..... G09G 1/16

[52] U.S. Cl. ..... 340/721; 340/703; 340/729; 340/793; 340/747

[58] Field of Search ..... 340/720, 721, 723, 724, 340/728, 729, 731, 747, 750, 703, 793

[56] References Cited

U.S. PATENT DOCUMENTS

| | | | |
|---|---|---|---|
| 3,585,629 | 6/1971 | Baynard, Jr. | 340/793 |
| 3,602,702 | 8/1971 | Warnock | 340/729 |
| 3,665,408 | 5/1972 | Erdahl et al. | 340/729 |
| 4,075,700 | 2/1978 | Blay | 340/729 |
| 4,116,444 | 9/1978 | Mayer et al. | 340/745 |
| 4,212,008 | 7/1980 | Hopkins, Jr. | 340/723 |
| 4,222,048 | 9/1980 | Johnson | 340/747 |
| 4,266,242 | 5/1981 | McCoy | 358/183 |
| 4,384,338 | 5/1983 | Bennett | 340/729 |
| 4,414,628 | 11/1983 | Ahuja et al. | 340/721 |

OTHER PUBLICATIONS

*Video Display Processor Simulates Three Dimensions,* Guttag et.al.; Electronics, vol. 53, No. 25; pp. 123–126; 11/20/80.

*Primary Examiner*—Marshall M. Curtis

*Attorney, Agent, or Firm*—Francis I. Gray; John H. Bouchard; Allston L. Jones

[57] ABSTRACT

A method and apparatus is disclosed for independently displaying one of a plurality of images on a display and for superimposing the plurality of images onto one another to produce a composite image. One or more bit planes are selected to constitute a group (defined to be a "surface"), and one or more additional bit planes are selected to constitute another group. The number of groups corresponds to the number of images to be independently displayed. The priority of one group over the other is selected. This ensures that the image from the one group (surface) appears to be "in front of" the images from the other group (surface) on the display. In the case of a color terminal, the colors associated with each group are selected. A color map memory contains a plurality of brightness indices which determines image brightness. Associated with each index is one or more color indices. The bits associated with each pixel are used as an index to the color map memory by locating the corresponding color (or gray) indices. The associated brightness index is noted, and converted to an analog voltage for determination of image brightness. In response to the selection of the groups mentioned hereinabove, and the designation of priority among groups, the firmware recomputes the color map in the color map memory, that is, the color indices are set based upon the number of selected groups and the number of bit planes per group, and selected ones of the brightness indices are recomputed based on the designated priority among groups. Due to the ability of the present invention to select one or more bit planes to constitute a group, and due to the firmware's ability to recompute the color map, one or more images can be displayed on the CRT, either independently of one another, or superimposed upon one another to produce a composite image.

3 Claims, 18 Drawing Figures

SURFACE NUMBER 2

SURFACE NUMBER 3

METHOD AND APPARATUS FOR DISPLAYING IMAGES

BACKGROUND OF THE INVENTION

1. Field of the Invention

The present invention is directed to a method and apparatus for producing a discrete or composite image on a CRT (cathode ray tube) screen from selected digital data stored in one or more memory storage areas.

2. Description of the Prior Art

Some graphics display terminals of the prior art utilized the digital data stored in a number of memory storage areas, hereinafter referred to as bit planes, to generate a display on a CRT. Referring to FIG. 1, the prior art terminal's raster memory comprises three bit planes. For each pixel location on the CRT screen, there is a one-bit memory cell in each of the bit planes. Referring to FIG. 2, for any one pixel, the bits in each bit plane collectively constitute a pixel word. The pixel word is used as an address to a table stored in a color map memory, and a corresponding brightness index is noted and read therefrom. The brightness index, a binary number, is converted into an analog signal via a D to A converter, the analog signal energizing the cathode ray tube to determine the brightness of the image at the particular pixel. FIG. 2 illustrates the hardware needed to generate a color display. In this figure, there are three D-A convertors, one for each of the additive primary colors. The outputs therefrom determine the brightness of the red, green, and blue phosphors for each pixel of the display.

To display information on the screen, circuitry in the terminal scans all of the bit planes, simultaneously. For each pixel on the screen, the circuitry reads one binary bit from each plane. All of the bits for each pixel location collectively form the pixel word mentioned hereinabove.

Since all of the bit planes are scanned simultaneously; and since all of the bits read therefrom collectively form the pixel word, only one image could be formed on the CRT. This limits the terminals capability. If it was desired to create two or more images and to display the images on the CRT either independently of one another or superimposed onto one another, the graphics display terminals of the prior art could not perform this function.

SUMMARY OF THE INVENTION

It is a primary object of the present invention to provide a system capable of enabling a graphics display terminal to display one or more images on a CRT, either independently of one another or superimposed upon one another to form a composite image.

It is an another object of the present invention to enable an operator to select one or more bit planes to constitute a "surface", the remaining bit planes constituting one or more "surfaces", whereby more than one surface may be created from which more than one image may be displayed on a CRT, the present invention displaying each of the images either independently of one another or superimposed on one another to form a composite image.

It is still another object of the present invention to enable the operator to select a priority among surfaces, such that one surface, which includes one or more bit planes, may produce an image on the CRT which appears to be "in front of" another image produced by a second surface, also containing one or more bit planes.

These and other objects of the present invention are accomplished by enabling the user to build a pixel representation of a composite image, of one of a plurality of images which comprise the composite image, or of more than one of said plurality of images. The pixel representation may be represented by a first group of bits and a second group of bits, the first group being used as a first index to a table, the second group being used as a second index to the table. The first and second indices are used to select brightness indices which are, in turn, used to determine the brightness of one or more images to be displayed on a CRT. The first group of bits is representative of a first image to be displayed on the CRT, the second group of bits being representative of a second image to be displayed on the CRT. Due to the existence of the first and second group of bits and their corresponding first and second indices to the table, the brightness indices in the table may be recomputed as necessary to display the images on the CRT with the proper priority.

Specifically, these objects are accomplished by enabling the user to select how many bit planes will constitute a surface, and how many surfaces to use in formulating the images on the CRT. The user specifies the priority of the surfaces, that is, which image, produced from one of the surfaces, will appear to be "in front of" another image, produced from another of the surfaces, when displayed on the CRT. In the case of a color graphics display terminal, the user selects the colors associated with each of the surfaces. Given the above information, the firmware computes separate surface information for each surface selection, each set of surface information constituting a binary series of 1's and 0's, one binary bit in the surface information being associated with each bit plane. For example, in the case of 4 bit planes, if planes 1 and 2 constitute one surface, and planes 3 and 4 constitute another surface, the surface information for the former surface selection will be 1100 and the surface information for the latter surface selection will be 0011. The 'one' binary bits in the surface information (as above) will enable a respective ALU control, an arithmetic logic unit. Enablement of an ALU control will cause the ALU control to develop an output signal which will, in turn, enable a bit plane. In the case of surface information 1100, bit planes 1 and 2 will be enabled, but bit planes 3 and 4 will not be enabled. For surface information 0011, bit planes 1 and 2 will not be enabled, but bit planes 3 and 4 will be enabled. Consequently, in the former case, bit planes 1 and 2 constitute a "surface". In the latter case, bit planes 3 and 4 constitute another "surface".

When the surface information is generated by the firmware, the firmware will compute the intersection between "surfaces" (i.e., between planes $\frac{1}{2}$ and $\frac{3}{4}$). If the user designated that surface 1 has priority over surface 2, the firmware will recompute the color map such that the brightness indices are readjusted and recomputed to reflect the priority of one surface over another. For example, if surface 1 has priority over surface 2, and each surface contains two bit planes, the brightness index for color index 1100, for example, is used as the brightness index for color indices 1101, 1110, and 1111. The brightness index in the color map memory for 1101, 1110 and 1111 is changed accordingly by the firmware. In this way, according to the above example, regardless of the values of the color indices for surface 2, at the intersection, the color indices for surface 1 takes priority over the color indices for surface 2 and the color map memory is changed to reflect this priority. The same is true of all color indices starting with 01XX and 10XX.

Further scope of applicability of the present invention will become apparent from the description given hereinafter. However, it should be understood that the details of the description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A full understanding of the present invention will be obtained from the detailed description given hereinbelow and the accompanying drawings which are given by way of illustration only, and thus are not limitative of the present invention, and wherein.

DETAILED DESCRIPTION OF THE INVENTION

Figure 3A:
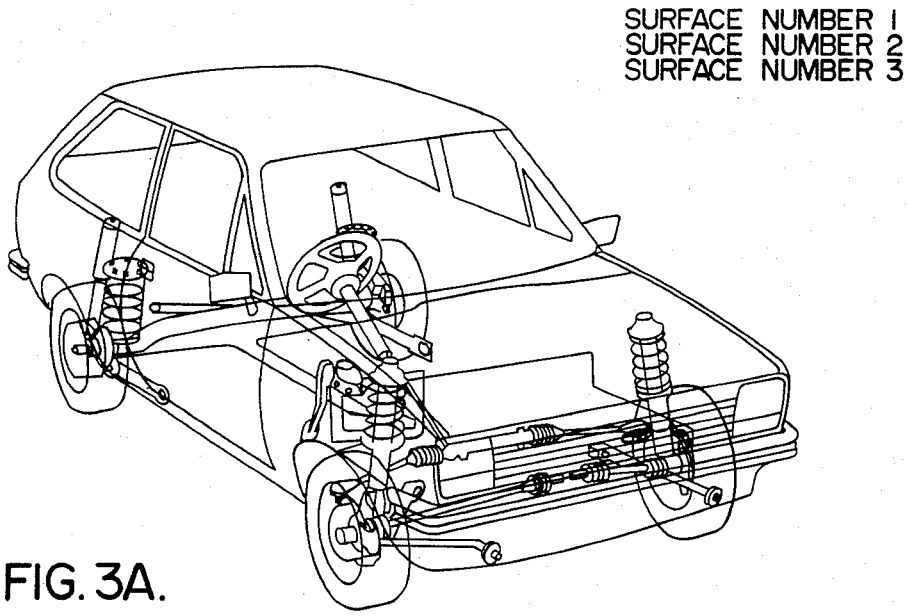
FIG. 3*a* represents an example of the use of the "surfaces" concept wherein the image of this figure is a composite image of FIGS. 3*b–d;*
Figure 3B:
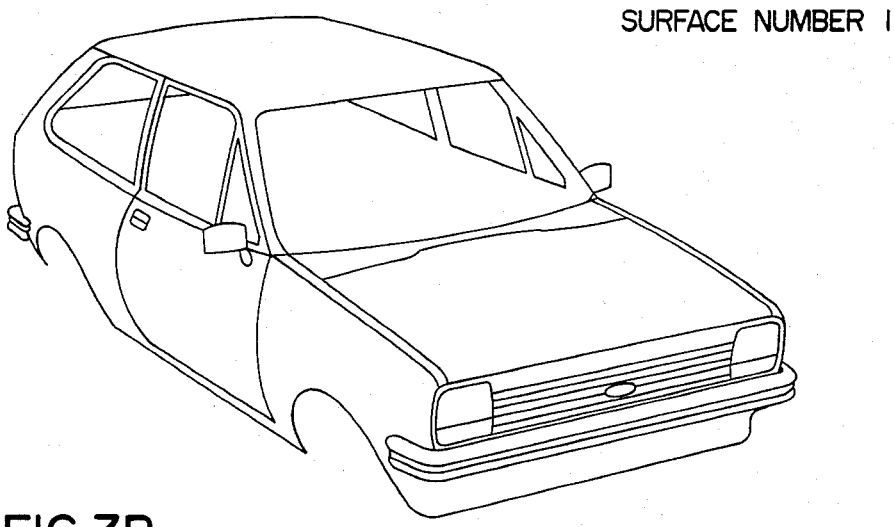
FIG. 3*b* represents a perspective outline drawing of the body of an automobile.
Figure 3C:
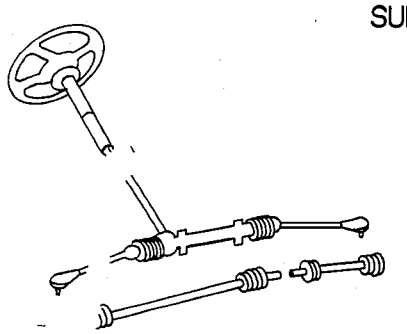
FIG. 3*c* represents the steering well and control linkage to the front wheels of an automobile.
Figure 3D:
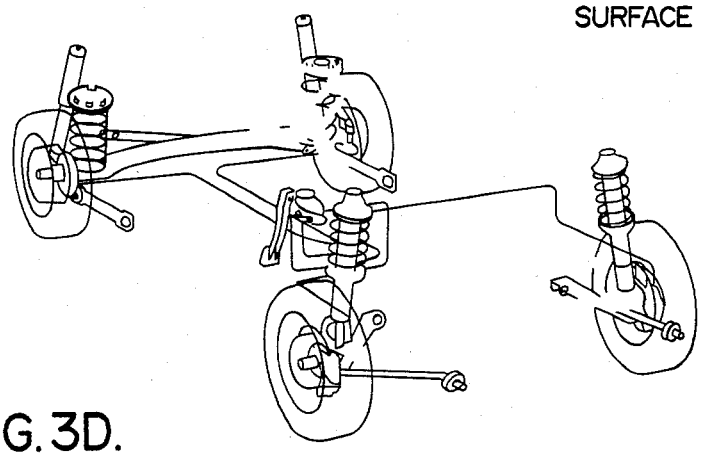
FIG. 3*d* represents the suspension, wheels, and partial chasis details of an automobile.

The concept of multiple surfaces for a graphics display terminal can be more fully appreciated by reference to FIGS. 3*a* –3*d* of the drawings. Referring to FIG. 3*a*, a CRT display is shown illustrating an automobile including the chassis, the steering column mechanism and the body of the automobile. FIG. 3*a* shows a composite display of all of these portions of the automobile simultaneously. Referring to FIG. 3*b*, only a display of the body of the automobile is shown. Referring to FIG. 3*c*, only a portion of the steering column mechanism is shown. Referring to FIG. 3*d*, only the chassis of the automobile is shown. By superimposing FIGS. 3*c* onto 3*d* and FIG. 3*b* onto the combined image of 3*c* and 3*d*, the image display of the automobile shown in FIG. 3*a* would result. Consequently, by use of the present invention, either one of FIGS. 3*b*, 3*c*, or 3*d* may be displayed independently of one another on the CRT. Alternatively, FIGS. 3*b*, 3*c*, and 3*d* may be combined and superimposed on one another to result in the image display shown in FIG. 3*a*.

Figure 1:
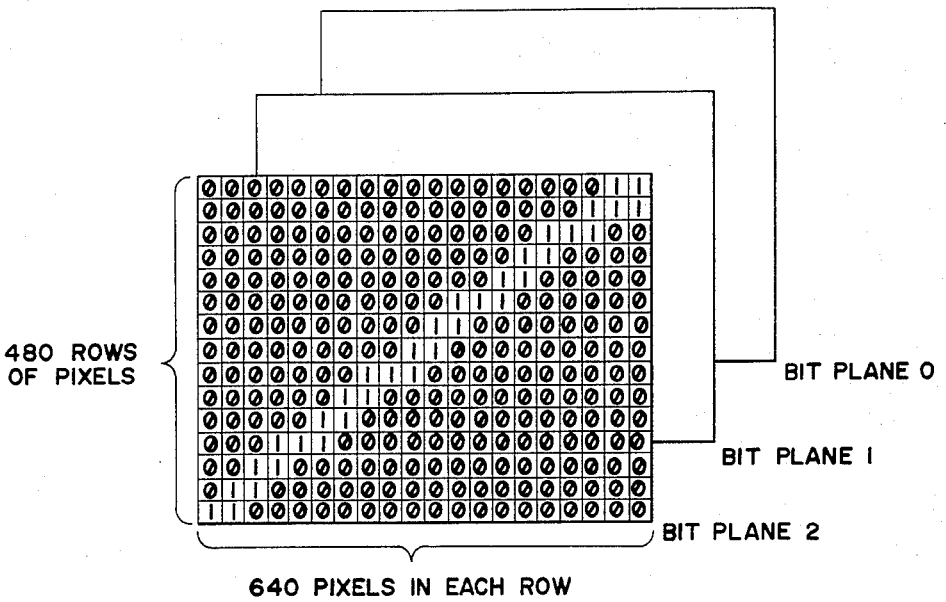
FIG. 1. (PRIOR ART)
FIG. 1 illustrates three bit planes and the memory cells in each bit plane.
Figure 4A:
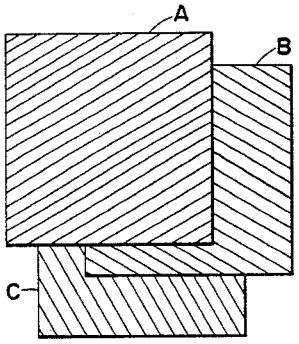
FIG. 4*a*, 4*b* and 4*c* represents an example of the "priority" concept wherein one image, produced from one surface, takes priority over another image, produced from another surface.
Figure 4B:
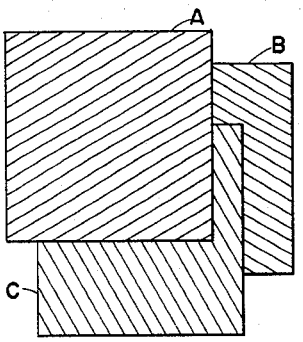
Figure 4C:
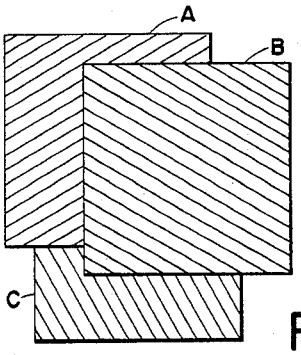

Referring to FIGS. 4*a* –4*c*, a concept of "priorities" will be discussed and explained. In some cases, it may be desirable to change priorities of the individual displays shown on the CRT. In the example shown in FIG. 3, FIG. 3*b* must have priority over FIG. 3*c* or 3*d*. This is because the body of the automobile must be shown and displayed as being "in front" of the steering column and the chassis. In FIG. 4, particularly FIG. 4*a*, note that surface A is shown as being in front of surface B. Note that surface B is shown as being in front of surface C. Consequently, surface A has priority over surface B, and surface B has priority over surface C. In FIG. 4*b*, however, the priorities have changed. Note that surface A still has priority over both surfaces B and C. However, surface C now is shown as being in front of surface B. In FIG. 4*c*, the priorities have changed again. In this case, surface B has priority over both surfaces A and C. Surface B is shown as being in front of surface A, and surface A is shown as being in front of surface C. Thus, with the present invention, the user/operator can designate which images can be shown on the CRT as being in front of which other images. He does this by designating priorities, that is, establishing the priority of one image display over another. By doing so, he will affect the display in the manner shown in FIGS. 4*a*–4*c*.

The results achieved by use of the present invention have been discussed and illustrated in the above text in conjunction with FIGS. 3 and 4 of the drawings. The following discussion in the paragraphs to follow will describe how these results have been achieved by use of the present invention.

Figure 2:
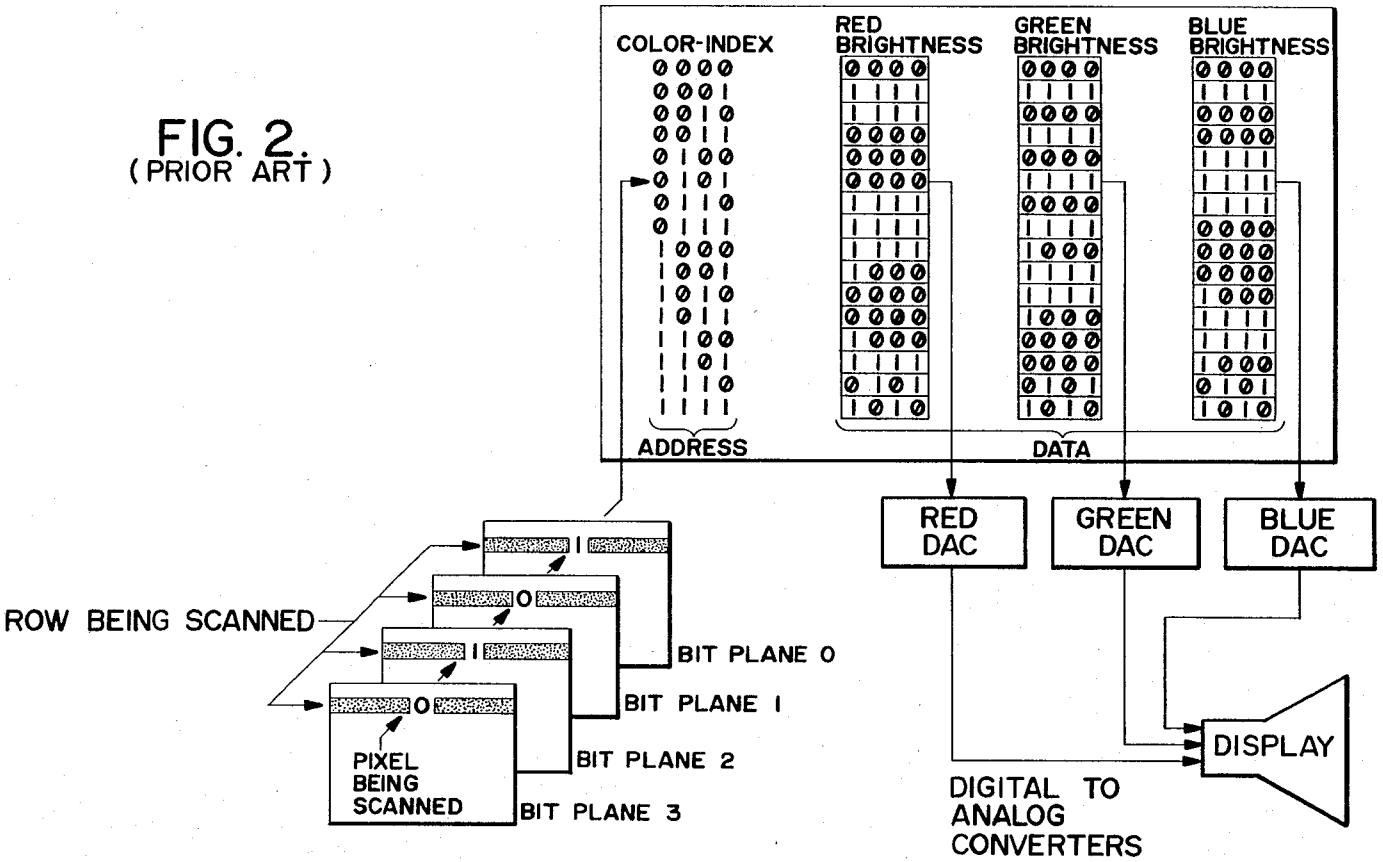
FIG. 2 (PRIOR ART)
FIG. 2 illustrates the hardware display circuitry for a prior art terminal displaying color images.
Figure 5:
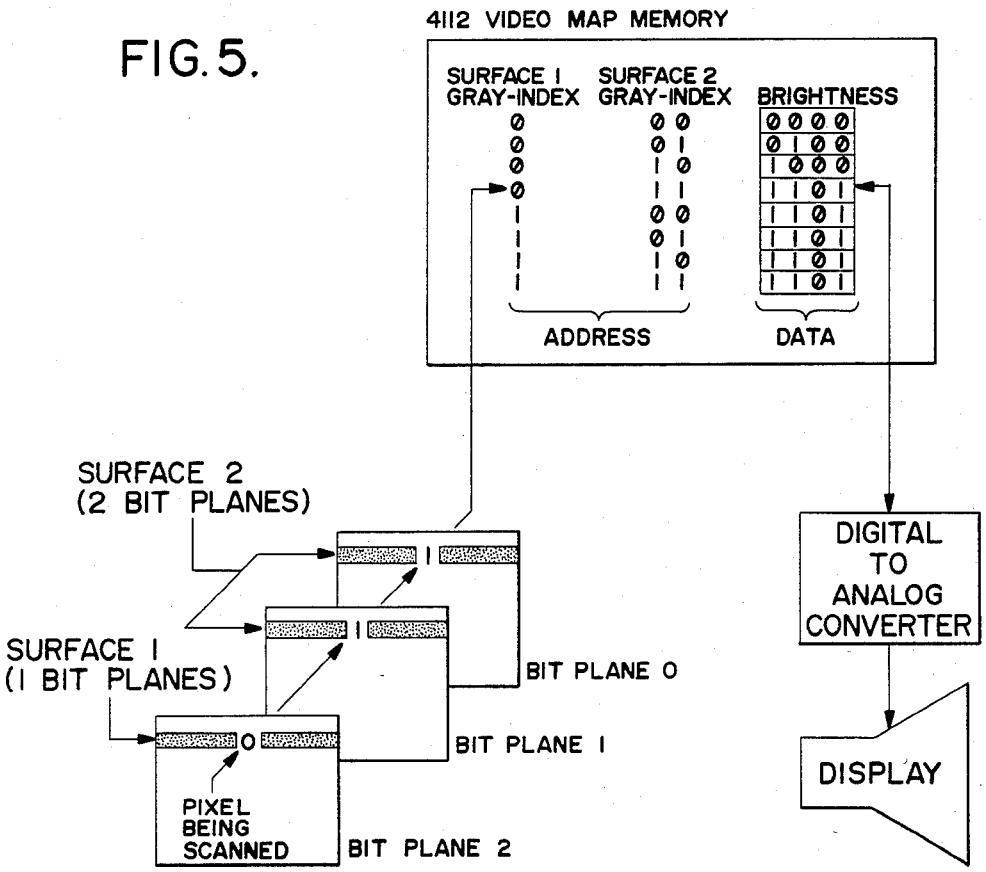
FIG. 5 is a schematic of a hardware configuration utilizing the "surface" technique of the present invention, shown for a gray-to-black graphics display terminal.

Referring to FIG. 5, note that bit plane 2 has been designated as surface 1. Further note that bit planes 0 and 1 have been designated as surface 2. By virtue of this designation, there are now two "surfaces" from which two images on the CRT display are created. Compare FIG. 5 with FIG. 2, the latter figure illustrating the prior art. In FIG. 2, only one "surface" was capable of being designated. That one surface included all of the bit planes, bit planes 0 through 3. Consequently, with reference to FIG. 5 again, it can be seen that one of the major distinctions of the present invention over the prior art is the ability of the present invention to designate more than one "surface", from which the necessary binary-bit information is acquired, for generating more than one image on the CRT display.

Referring to FIG. 5 again, note the pixel being scanned in bit plane 2, surface 1. The pixel being scanned is 0. In surface 2, for that same pixel being scanned, the binary digits 11 are noted. The bit 0, associated with surface 1, is located in the video map memory in the column entitled "surface 1 gray index". The binary bits 11 are also located adjacent the binary digit 0 associated with surface 1, in the column entitled "surface 2 gray index". Comparing FIG. 5 with FIG. 2 note that there is a gray index associated with surface 1 in the video map memory of FIG. 5 and there is a separate gray index for surface 2 of FIG. 5. In FIG. 2, however, there is only one gray index associated with all four bit planes. Consequently, as can be seen from FIG. 5, surface 1 has been designated separately from surface 2, and a surface 1 gray index has been created separate and apart from a surface 2 gray index in the video map memory. Once the gray index 0 for surface 1 is located adjacent to the gray index 11 for surface 2 in the video map memory, the corresponding brightness index 1101 is noted and read from the video map memory. The D to A converter converts this brightness index (a binary code) into an analog voltage for generation of an image on the CRT display.

In the above paragraph, the concept of a "surface" has been defined as being a combination of one or more bit planes associated together, each surface having a separate gray index (a binary code) in the video map (color) memory.

The user supplies the following information via the keyboard (or host interface) of the graphics display terminal of the present invention:

(1) The user supplies how many "surfaces" there will be, and how many bit planes will constitute each surface;

(2) The user specifies the priority of the surfaces (the definition of "priority" is as defined with respect to FIGS. *4a–4c* of the drawings of the present application);

(3) The user specifies the colors which will be used on each surface for color graphics display terminal and specifies the gray color for black and white displays;

(4) Given the above information, the firmware in the ROM recomputes the brightness indices associated with the gray (or color) indices stored in the video map memory.

One of the basic concepts behind the present invention resides in the fact that the firmware will recompute the color map, that is, the brightness indices stored in the video map memory will be recomputed when information is supplied with respect to the number of surfaces, the number of bit planes per surface, the priority of the surfaces, and the colors for each surface. For example, if it is desired to display only one image on the CRT from one surface, without also displaying any of the other images from the remaining surfaces, the firmware will "recompute the color map" stored in the video map memory, i.e., it will recompute the brightness indices associated with some of the affected gray (or color) indices and substitute the recomputed brightness indices therefor. Once the color map is recomputed, and the pixels on the "surfaces" are scanned, only the desired image from the single corresponding "surface" will be displayed on the CRT.

Figure 6:
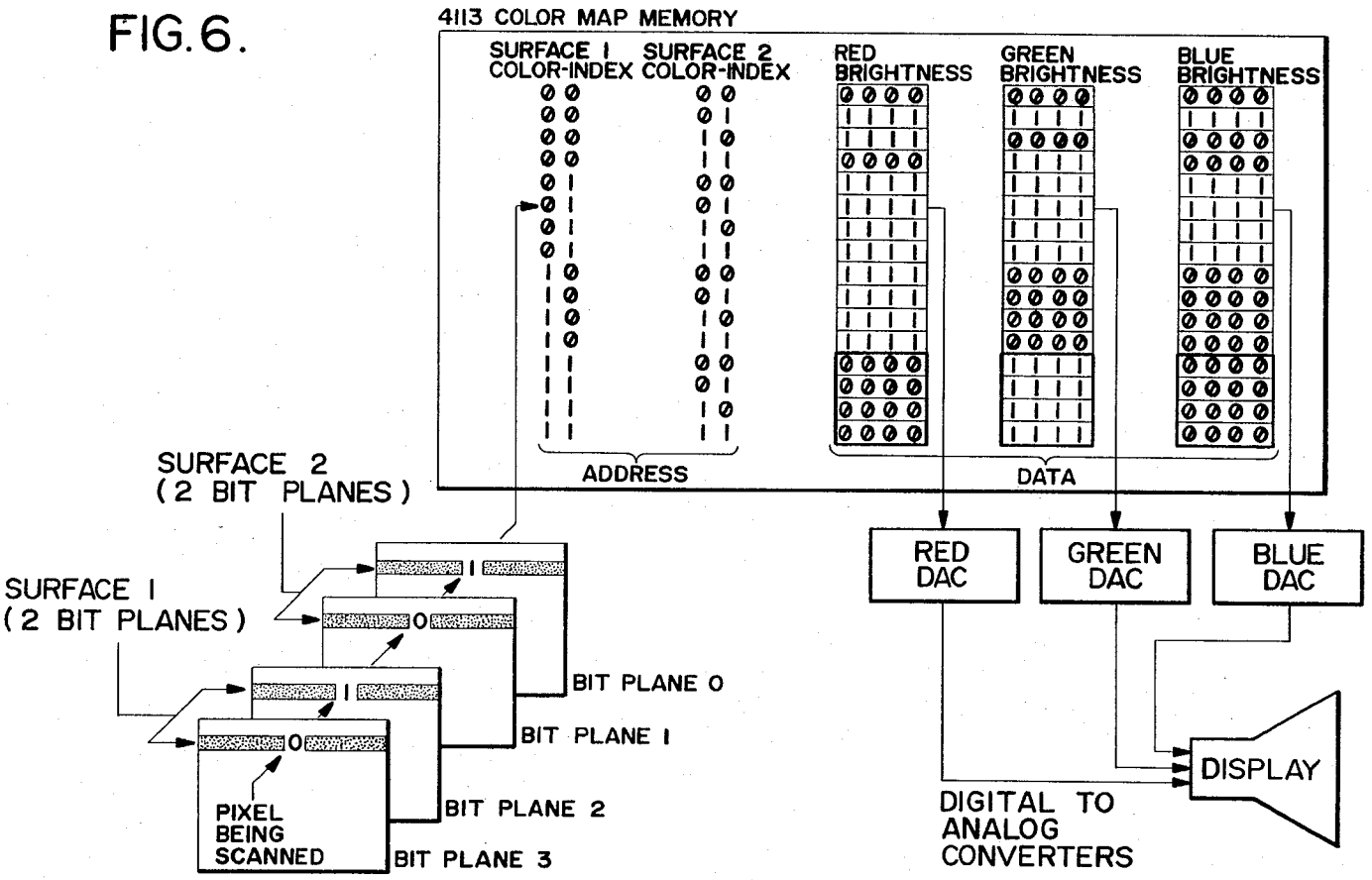
FIG. 6 is a schematic of a hardware configuration utilizing the "surface" technique of the present invention, shown for a color graphics display terminal. This figure also illustrates the priority concept wherein surface 1 takes priority over surface 2.

Refer to FIG. 6. This figure illustrates an example of the entry of a certain priority of one surface over the other, and the firmware's recomputation of the color map stored in the video (or color) map memory to reflect that particular priority. In FIG. 6, surface 1 is designated by the operator as being in front of surface 2, on the CRT display. Surface 1 color indices in the color map memory take priority over the surface 2 indices in the color map memory. For example, still referring to FIG. 6, let us suppose that the color index for surface 1 is a binary 11. If the color index for surface 2 at the same pixel is a binary 00, the brightness indices for the colors red, green, and blue will be 0000, 1111, and 0000, respectively. A binary 11 for surface 1 would indicate that an image will be produced on the CRT display associated with surface 1. However, a binary 00 from surface 2 at the same pixel would mean that there would be no image displayed on the CRT which would be associated with surface 2. Consequently, at the pixel location associated with pixel word 1100, there would be no intersection of two surfaces, and, consequently, at this pixel, priority is of no concern. However, at a pixel location associated with pixel word 1101 (wherein 11 is the color index associated with surface 1 and 01 is the color index associated with surface 2), the existence of binary code 01 for surface 2 indicates that there would be an intersection of two surfaces at this pixel location. The binary code 11 at surface 1 indicates an image will be displayed on the CRT associated surface 1. The code 01 at surface 2 indicates an image will be displayed on the CRT associated with surface 2. Consequently, since surface 1 takes priority over surface 2, in our example, the firmware recomputes the color map such that the brightness index codes for pixel word 1101 are the same as the brightness index codes for pixel word 1100. Consequently, the firmware substitutes the following brightness index codes into the color map memory associated with pixel word 1101: 0000, 1111, 0000. The firmware also changes, in the same manner, the brightness index codes in the color map memory associated with pixel words 1110, and 1111. As can be seen from the color map memory shown in FIG. 6, the brightness index codes associated with pixel words 1101, 1110, and 1111, for colors red, green, and blue have been changed. They are the same as the brightness index codes for pixel word 1100.

Figure 7:
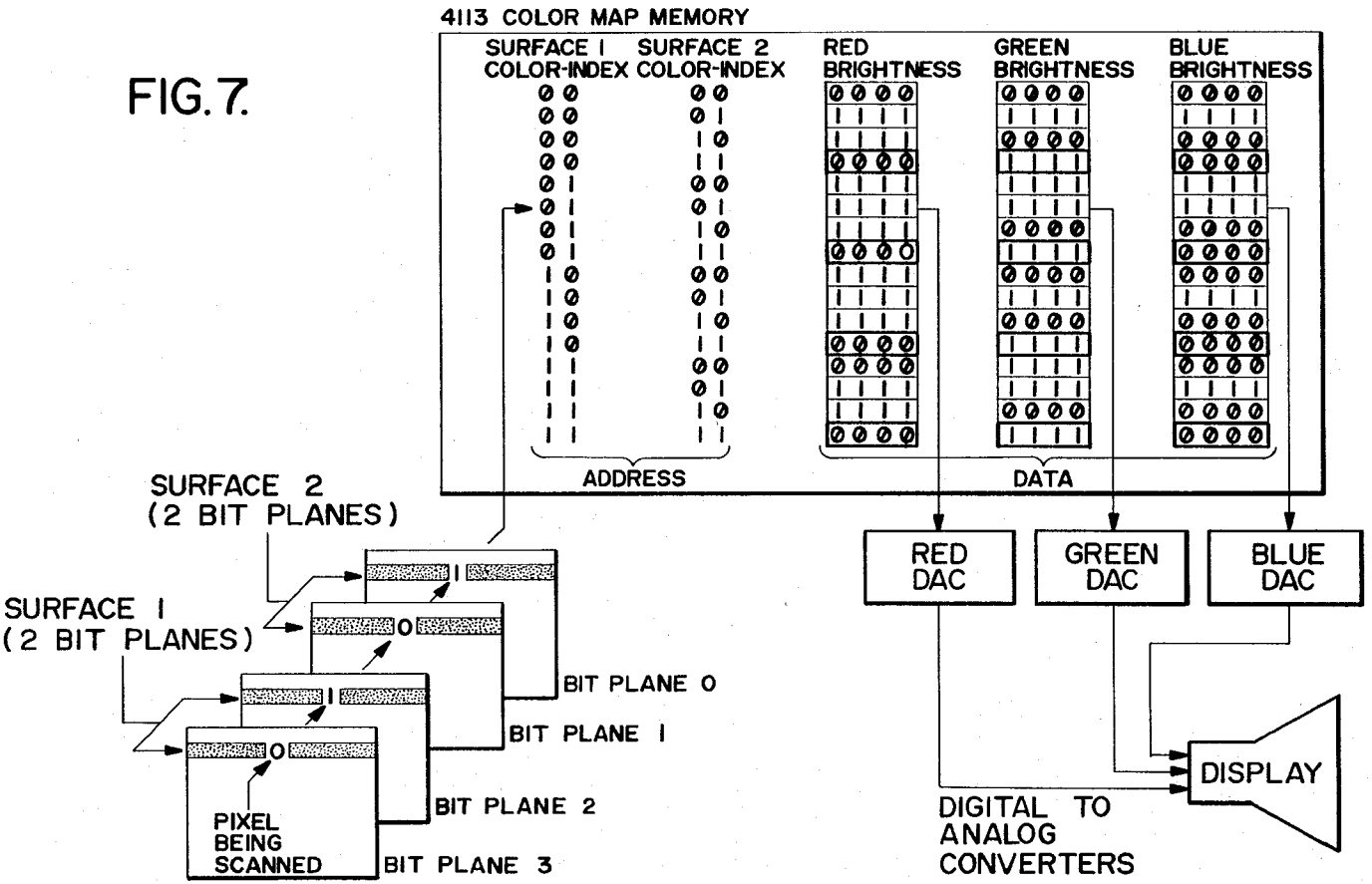
FIG. 7 is another schematic similar to the schematic of FIG. 6. However, this figure illustrates the priority concept wherein surface 2 takes priority over surface 1.

In FIG. 7, another example of the firmware's recomputation of the color map is shown. This example illustrates the recomputation of the color map when surface 2 is given priority over surface 1, that is, surface 2, is designated as being "in front of" surface 1, when displayed on the CRT. As before, the brightness indices associated with the red, green, and blue colors are changed accordingly in order to reflect the changed priority of surface 2 over surface 1. Using the same binary digits as in the example of FIG. 6, a color index of 00 for surface 1 and a color index of 11 for surface 2, in the color map memory, would indicate that an image will be displayed on the CRT associated with surface 2 but not with respect to surface 1 (because the color index for surface 1 is 00). Note the brightness indices for pixel word 0011 in the color map memory. These brightness indices are as follows: 0000, 1111, 0000. When color index for surface 1 is 01, and the color index for surface 2 is still 11, the firmware will change the color map memory such that the brightness indices for this pixel word, 0111, will be the same as the brightness indices associated with pixel word 0011. Similarly, the firmware will change the brightness indices associated with pixel words 1011 and 1111 to be the same as the brightness indices for pixel word 0011. In this way, regardless of the bit combination (color index) in surface 1, when the bit combination (the color index) in surface 2 is 11, the brightness indices will always be 0000, 1111, 0000. In this way the priority of surface 2 over surface 1 will be guaranteed. In FIG. 7, note the changes made to the color map memory. The firmware has recomputed the color map memory (i.e., changed the brightness indices) in response to a change in priorities. Note that the brightness indices for pixel words 0011, 1011 and 1111 are all the same.

The above discussion has demonstrated that the firmware will recompute the color map, that is, will change the brightness indices associated with certain ones of the color indices in the color map memory in response to a change in priorities of one surface over the other. If, in response to actuation of a key of the keyboard (or host interaction), the operator has indicated that one or more of the images displayed on the CRT should be invisible, the firmware will again recompute the color map in a similar manner as mentioned above in order to display the image associated with only the desired surface.

Figure 8:
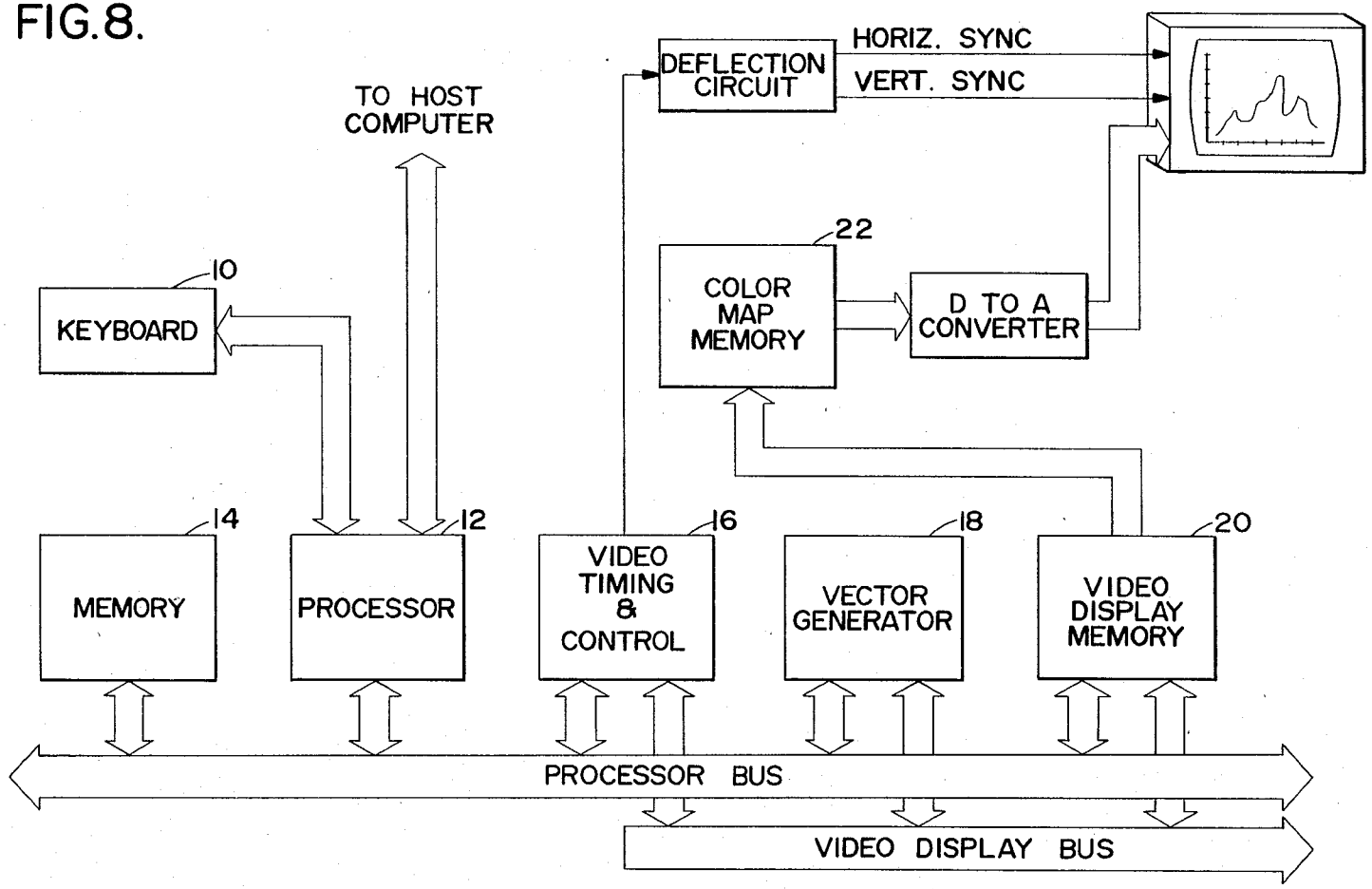
FIG. 8 illustrates the basic hardware circuitry in the graphics display terminal of the present invention.

Referring to FIG. 8, a block diagram of the graphics display terminal of the present invention is illustrated. The keyboard 10 and the host computer is connected to a processor 12. The processor 12 comprises a microprocessor on a ROM connected thereto. An Intel 8086 can be used to perform the function of the microprocessor. The keyboard 10 and the host computer are connected to the microprocessor. The firmware is stored in the ROM of the processor 12. The microprocessor is connected to a processor bus. A memory 14 is also connected to the processor bus and stores a series of bits therein hereinafter referred to as a surface information index. A video display memory 20 is connected to the processor bus and stores therein the pixel data which is ultimately used to determine the brightness indices for each of the pixels for controlling the image brightness during the raster scan. The pixel representation of the composite image, of one of a plurality of images, or of a combination of more than one of said plurality of images is stored in the video display memory 20. A vector generator 18 is connected to the processor bus and generates the pixel data in response to instructions from the microprocessor, the pixel data being stored in the video display memory 20. The video timing and control circuit 16 is also connected to the processor bus and coordinates the read-out of the pixel data stored in the video display memory 20 with the generation of the horizontal and vertical sync signals from the deflection circuitry, the sync signals being used by the deflection coils of the CRT monitor to deflect the electron beams. The display memory 20 is also connected to a color map memory 22, the color map memory 22 being connected to the CRT via a D to A converter. When the pixel data for each pixel on the CRT is read out from the video display memory 20 by the video timing and control circuit 16, it is located in the color map memory 22 as an index to a table. The corresponding brightness indices are located, and converted to an analog voltage in a D/A converter. The analog voltage for the pixel energizes the electron guns and determines the image brightness at that pixel point.

Figure 9:
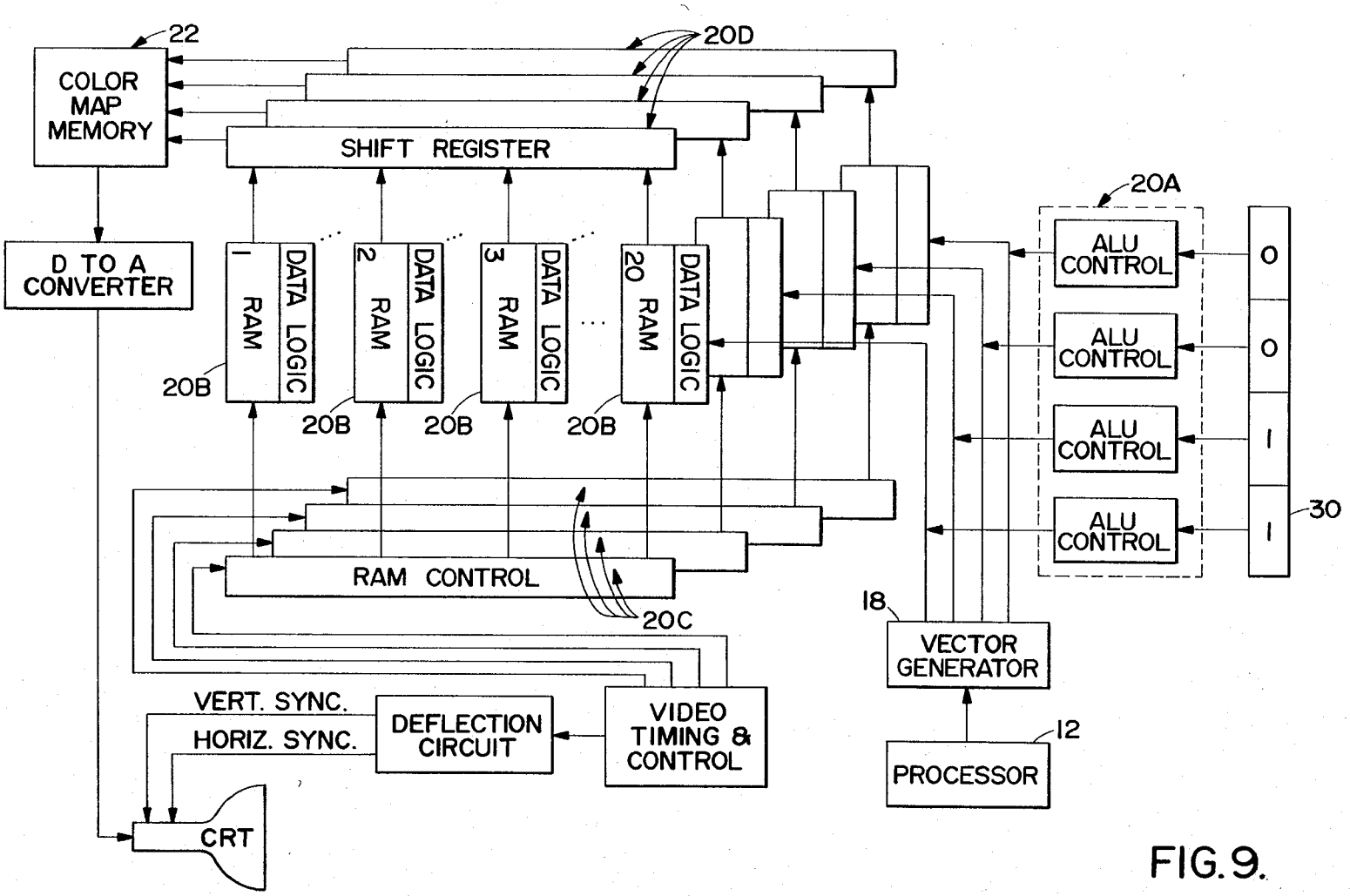
FIG. 9 is a further detail of the video display memory shown in FIG. 8.

A further detail of the video display memory 20 is shown in FIG. 9 of the drawings of the present application. In FIG. 9, the video display memory 20 comprises a plurality of ALU control circuits 20A, each of these ALU control circuits being nothing more than a register capable of being set to a 1 or 0 in response to an input signal. If the bit in the ALU register is set to 1, an output signal is developed therefrom. The output terminals of the ALU control circuits 20A are respectively connected to a plurality of bit planes. Each of the bit planes comprise a certain number of RAM/data logic circuits 20B, a RAM control circuit 20C, and a shift register 20D. In the example shown in FIG. 9, there are twenty RAM/data logic circuits 20B in each bit plane. Each line on the CRT is subdivided into a plurality of groups of pixels, each group containing, for example, twenty (20) pixels corresponding, respectively, to the twenty (20) RAM/data logic circuits 20B in each bit plane. Four bit planes are illustrated in the FIG. 9 circuit embodiment.

A RAM control 20C is associated with each bit plane and is connected, on one end, to each of the RAM/data logic circuits 20B for the bit plane. The RAM control circuits 20C are connected, on the other end, to the video timing and control circuit 16 of FIG. 8, and is therefore responsive to output signals generated therefrom. The outputs of each of the RAM/data logic circuits 20B in each bit plane are connected to a shift register 20D. The RAM control circuits 20C are responsible for reading out the pixel data from the corresponding RAM data logic circuits 20B for further storage in their corresponding shift registers 20D in response to the output signals from the video timing and control circuit 16.

Since there are four bit planes illustrated in the FIG. 9 circuit embodiment, there are four respective RAM control circuits 20C, four sets of RAM/data logic circuits 20B connected to the RAM control circuits 20C, each set including twenty RAM/data logic circuits, and four respective shift register circuits 20D connected to the output of the four respective sets of RAM/data logic circuits 20B.

The output of each of the shift registers 20D is connected to the color map memory 22 of FIG. 8. The output of the color map memory 22 is connected to a D to A converter, which is in turn connected to the electron guns of the CRT. Pixel data is supplied to each of the bit planes from the vector generator 18, which receives its information from the microprocessor.

Figure 11:
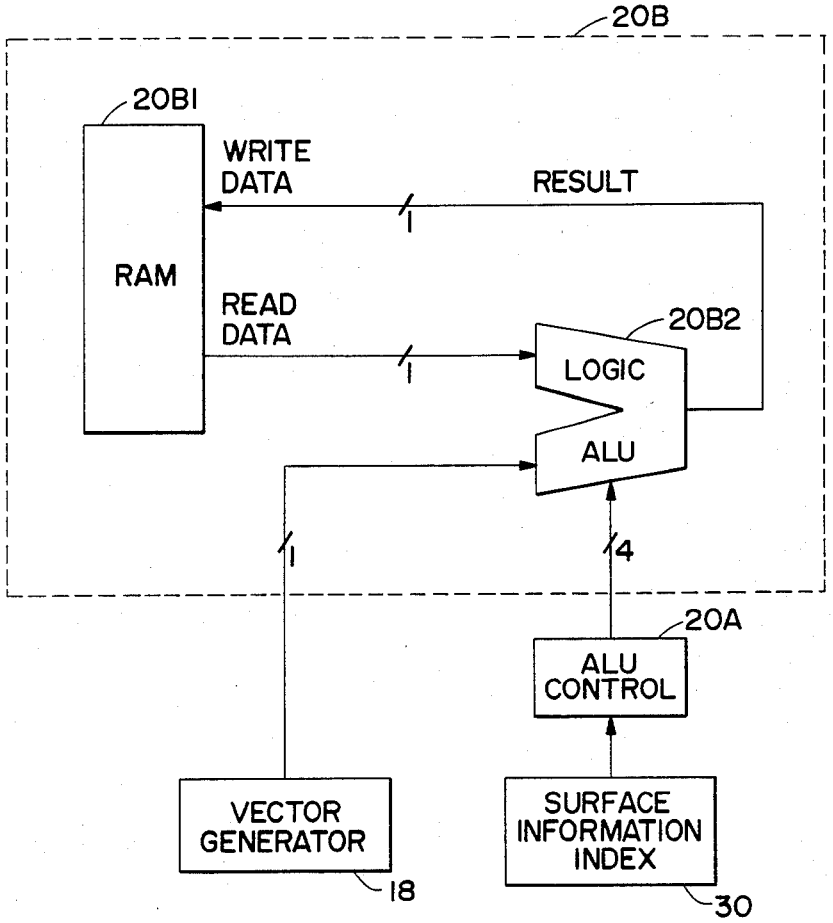
FIG. 11 is a further detail of the RAM/data logic block shown in FIG. 9.

Referring to FIG. 11, a further detail of the RAM/-data logic circuit 20B of FIG. 9 is illustrated. A RAM memory 20B1 is connected via a read/data terminal to one input of a logic/ALU circuit 20B2. The logic/ALU circuit 20B2 can be identified by an industry standard part no. 74LS181. Pixel data from the vector generator 18 of FIG. 8 is supplied to the other input terminal of the logic ALU 20B2. The ALU control circuit 20A is connected to still another input to the logic ALU circuit 20B2 of FIG. 11. An output of the logic ALU circuit 20B2 is supplied via a write/data input lead to the RAM memory 20B1.

Figure 10:
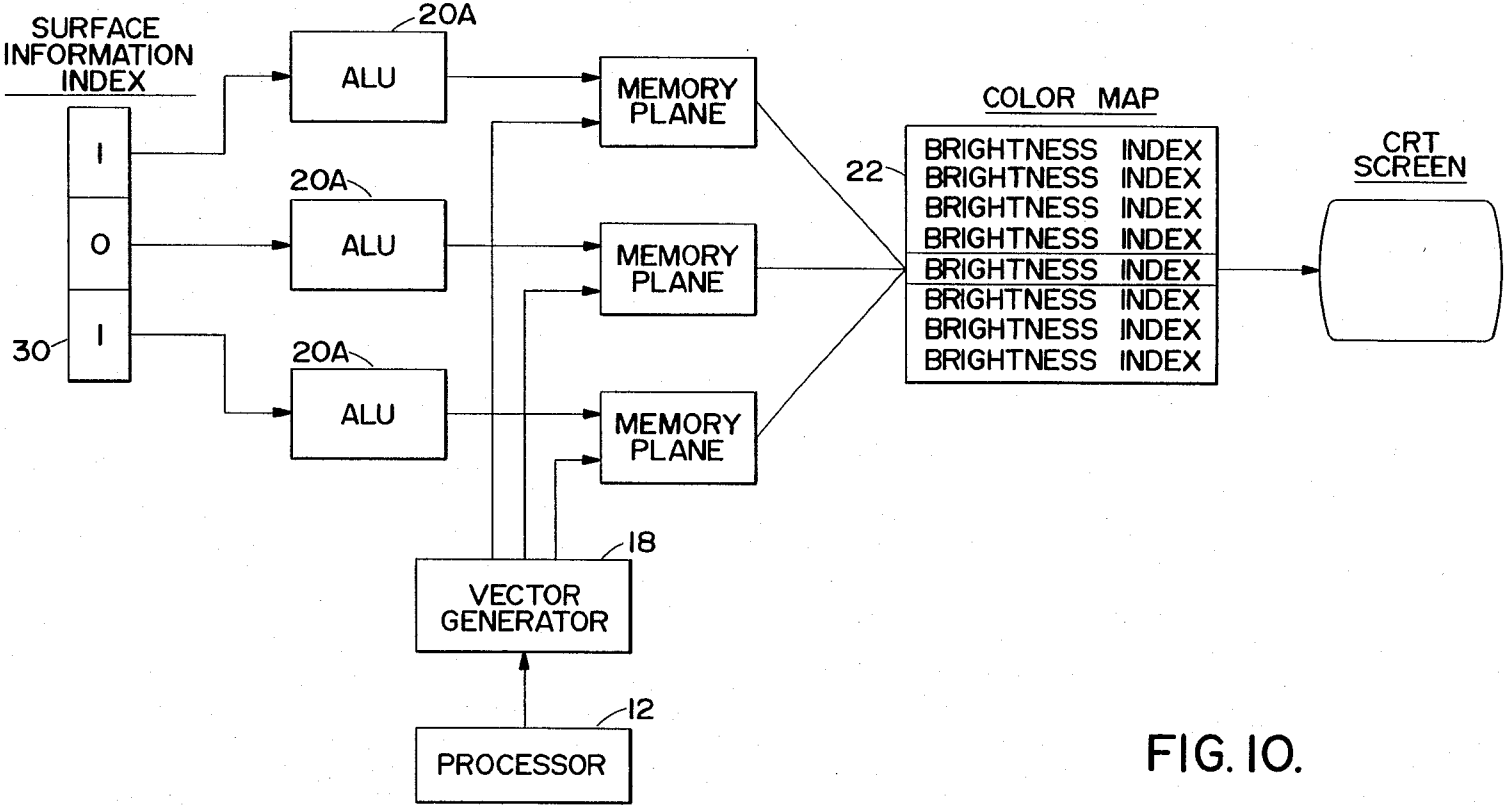
FIG. 10 represents a simplified functional block diagram of the operation of the circuits shown in FIGS. 8 and 9.

The operation of the circuits shown in FIGS. 8, 9, and 11 of the drawings can best be understood by reference to FIG. 10 of the drawings of the present application. The operator selects the number of "surfaces" to be utilized and the number of bit planes which constitute each surface. As mentioned hereinbefore, a "surface" is a combination of bit planes, the bits from each surface being used to index a table in a color map memory 22, the brightness indices associated with the located index numbers being used to generate a display image on a CRT. In response to the selection of the number of surfaces and the number of bit planes for each surface, the firmware stored in the ROM of processor 12 of FIG. 8 calculates a surface information index 30 associated with *each* surface selection. The surface information index 30, such as that which is shown in FIG. 10, is a combination of binary bits. The surface information index 30 for each surface selection is stored in the memory 14 of FIG. 8. The video timing and control circuit 16 of FIG. 8 reads the surface information indices 30 for each surface selection from the memory 14 of FIG. 8. Referring to FIG. 10, each of the binary bits associated with the surface information indices 30 energize the corresponding ALU control circuit 20A. In the example of FIG. 10, the first and third ALU control circuits 20A are energized in response to the binary bit "1" of the surface information index 30 stored in the memory 14. The ALU control circuit 20A, which is energized by the binary bit "0", is not enabled. Each of the ALU control circuits 20A is connected to a memory plane. Each memory plane of FIG. 10 contains the set of twenty RAM/data logic circuits 20B, the associated RAM control 20C, the associated shift register 20D shown in FIG. 9. Referring again to FIG. 10, if the ALU control circuit is enabled in response to a binary "1", it will generate an output signal further enabling its corresponding memory plane. In the example of FIG. 10, the first and third memory planes are enabled, however, the intermediate memory plane is not enabled. When a memory plane is enabled, the pixel data input thereto will be stored therein. If the memory plane is not enabled, the pixel data input thereto will *not* be stored therein. The pixel data, in FIG. 10, originates from the vector generator 18. The vector generator 18 received its instructions from the firmware processor 12. Consequently, since the first and third memory planes have been enabled by their corresponding ALU control circuits 20A, the pixel data input thereto will be stored therein. However, the pixel data associated with the intermediate memory plane will not be stored therein, since this memory plane has not been enabled by its corresponding ALU control circuit 20A. The enablement of the first and third memory planes, and the storage of pixel data therein, results in the selection of the first and third memory planes of FIG. 10 as constituting a surface. Just as bit planes 1 and 0 of FIG. 6 constituted surface 2, the first and third memory planes of FIG. 10 also constitute a "surface". The intermediate memory plane has not been selected as a member of this "surface" in FIG. 10.

The pixel data stored in the first and third memory planes of FIG. 10 constitute the color (or gray) indices which are used to index a table in the color map memory 22 of FIG. 10, to locate a color value, that is, a brightness index. Just as in FIGS. 5 and 6, the color value or brightness index is converted, in a D to A converter, to an analog voltage which determines the brightness of eventually generates a display image on the CRT. In our example shown in FIG. 10, this display image corresponds to the surface constituting the first and third memory planes.

Referring to FIG. 9, the surface information index 30 is shown as energizing the corresponding ALU control circuits 20A. For those ALU control circuits 20A which are energized by a binary bit "1" from the surface information index, an output signal is generated for enabling the corresponding memory planes. In the example of FIG. 9, the first two memory planes have been enabled and selected as constituting a "surface". Pixel data is applied to these two memory planes, and stored in the respective RAM/data logic circuits 20B therein, the pixel data originating from the vector generator 18. Since the second two memory planes are not enabled, pixel data is not applied to and stored in the RAM/data logic circuits 20B in these planes. When the pixel data is stored in the individual RAM/data logic circuits 20B of the first two memory planes in FIG. 9, the RAM control circuit 20C, in response to instructions from the video timing and control circuit 16 of FIG. 8, causes this pixel data to be read-out in parallel fashion from the RAM/data logic circuits 20B, the pixel data thus read-out being stored in its corresponding shift register 20D. When the pixel data from the first two memory planes have been stored in their corresponding shift registers 20D, the binary data in the two shift registers 20D are sequentially read therefrom in serial fashion. These binary data constitute color indices for addressing into the color map memory 22. This same technique is used with respect to the third and fourth memory planes, using a surface information index 30 of 1100 to enable these memory planes. Once the brightness index associated with the combination of the two surface color indices is located in the color map memory 22, it is converted to an analog voltage in the D to A converter. The analog voltage determines image brightness. The video timing and control circuit 16 synchronizes the application of this analog voltage to the electron guns of the CRT with the generation of the horizontal and vertical sync pulses from the deflection circuitry used to deflect the electron beam during the raster scan. It is noted that the binary bits read from the first two shift registers constitute only one of the two color indices whose combination is used as an index to a table in the color map memory 22 in FIG. 9 for further location of the corresponding brightness index associated therewith.

Referring to FIG. 11, a further description of the operation of the RAM/data logic circuit 20B is given. In FIG. 11, if the ALU control circuit 20A is enabled in response to a binary bit "1" from the surface information index 30, an output signal is generated therefrom which energizes the logic ALU circuit 20B2 in FIG. 11. Data is read from the RAM 20B1 and stored in the logic ALU circuit 20B2. If the ALU control circuit 20A energizes the logic ALU circuit 20B2, the pixel data supplied thereto from the vector generator 18 will be stored in the logic ALU circuit 20B2 in place of the data read from the RAM 20B1. The new pixel data stored in the logic ALU circuit 20B2 will then be written back into the RAM 20B1. If the ALU control circuit 20A does not energize the logic ALU circuit 20B2, the data read from the RAM 20B1 and stored in the logic ALU circuit 20B2 will not be changed or modified.

Figure 12A:
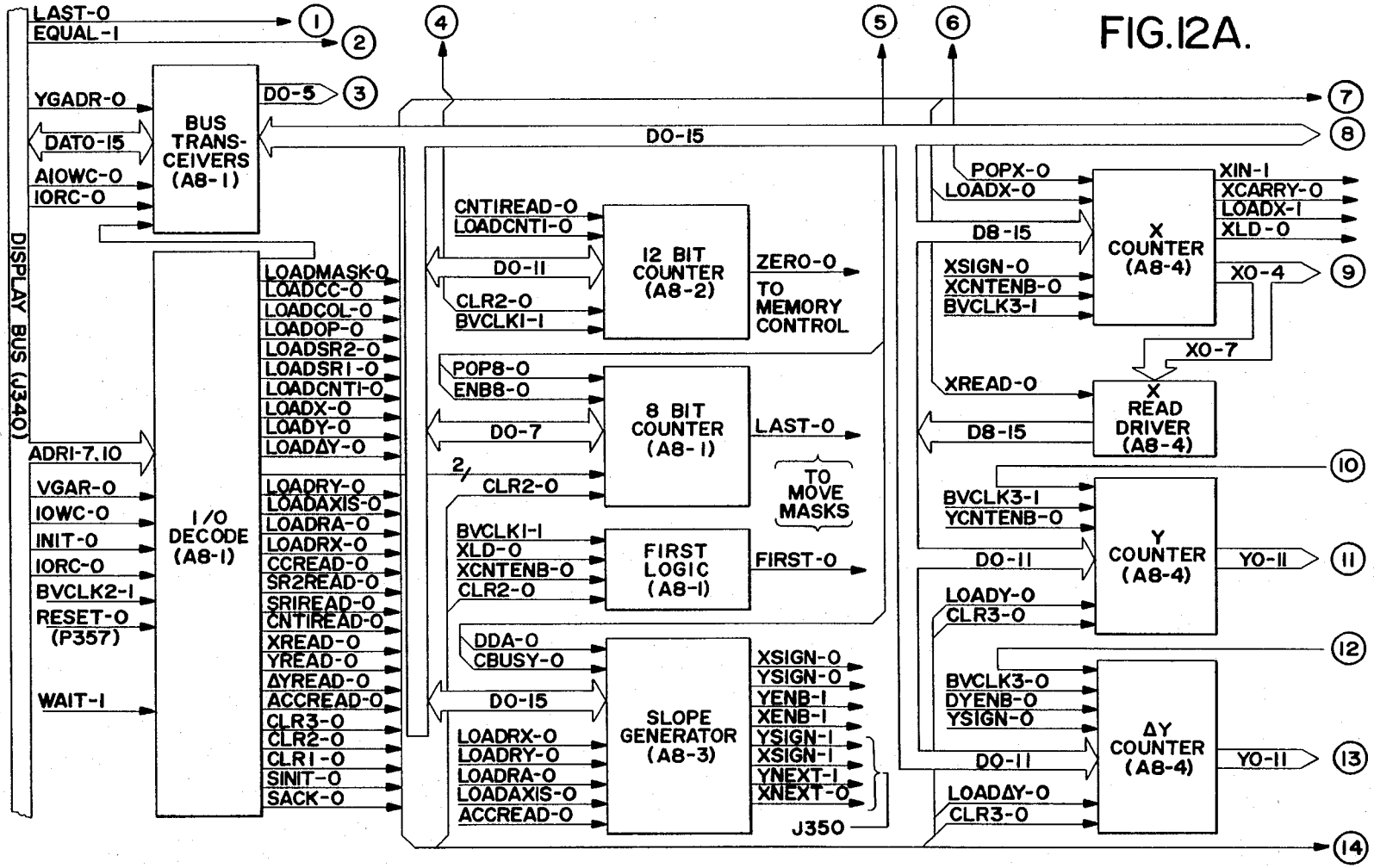
FIG. 12 is a system block diagram of the vector generator shown in FIG. 8.
Figure 12B:
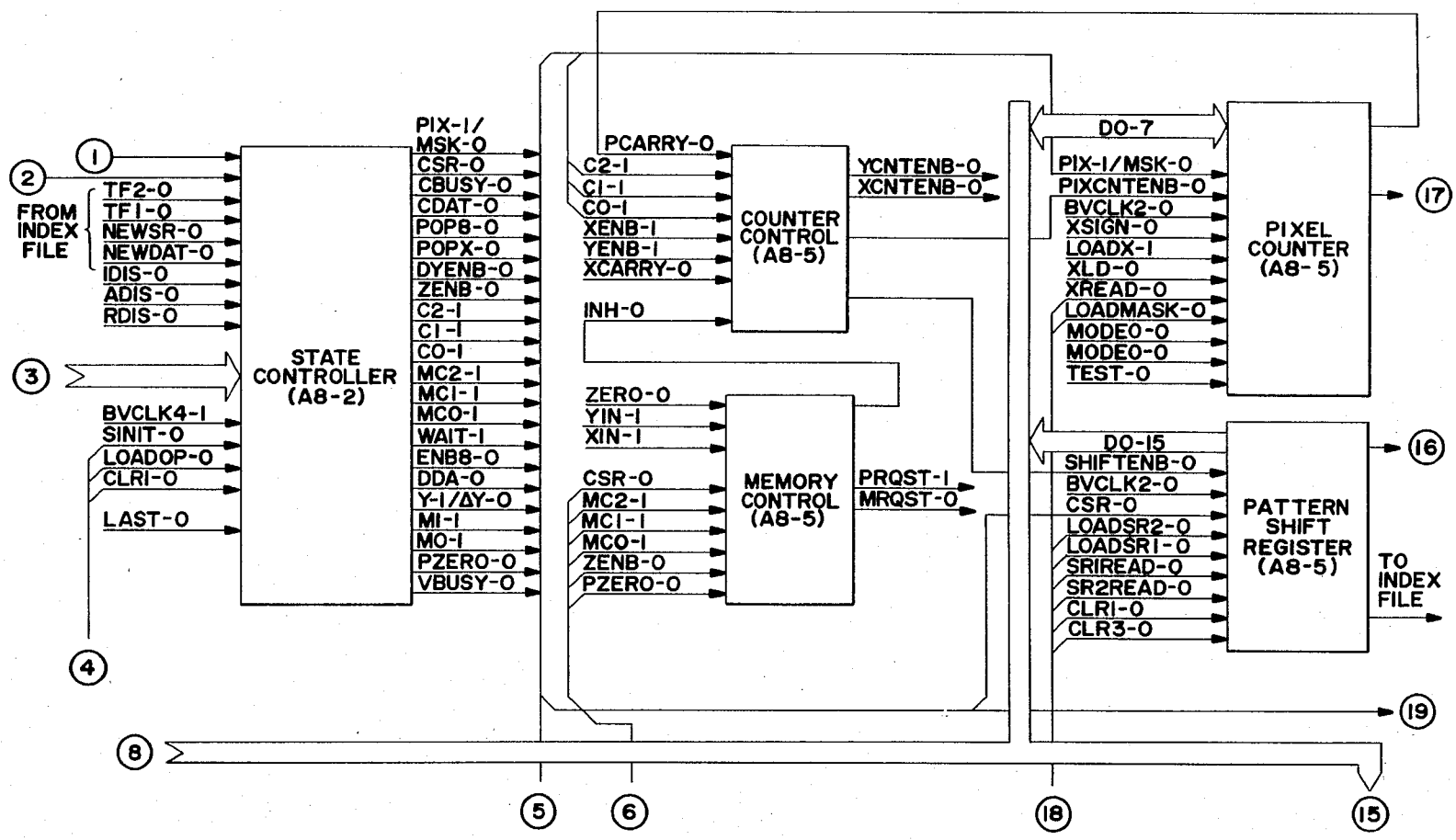
Figure 12C:
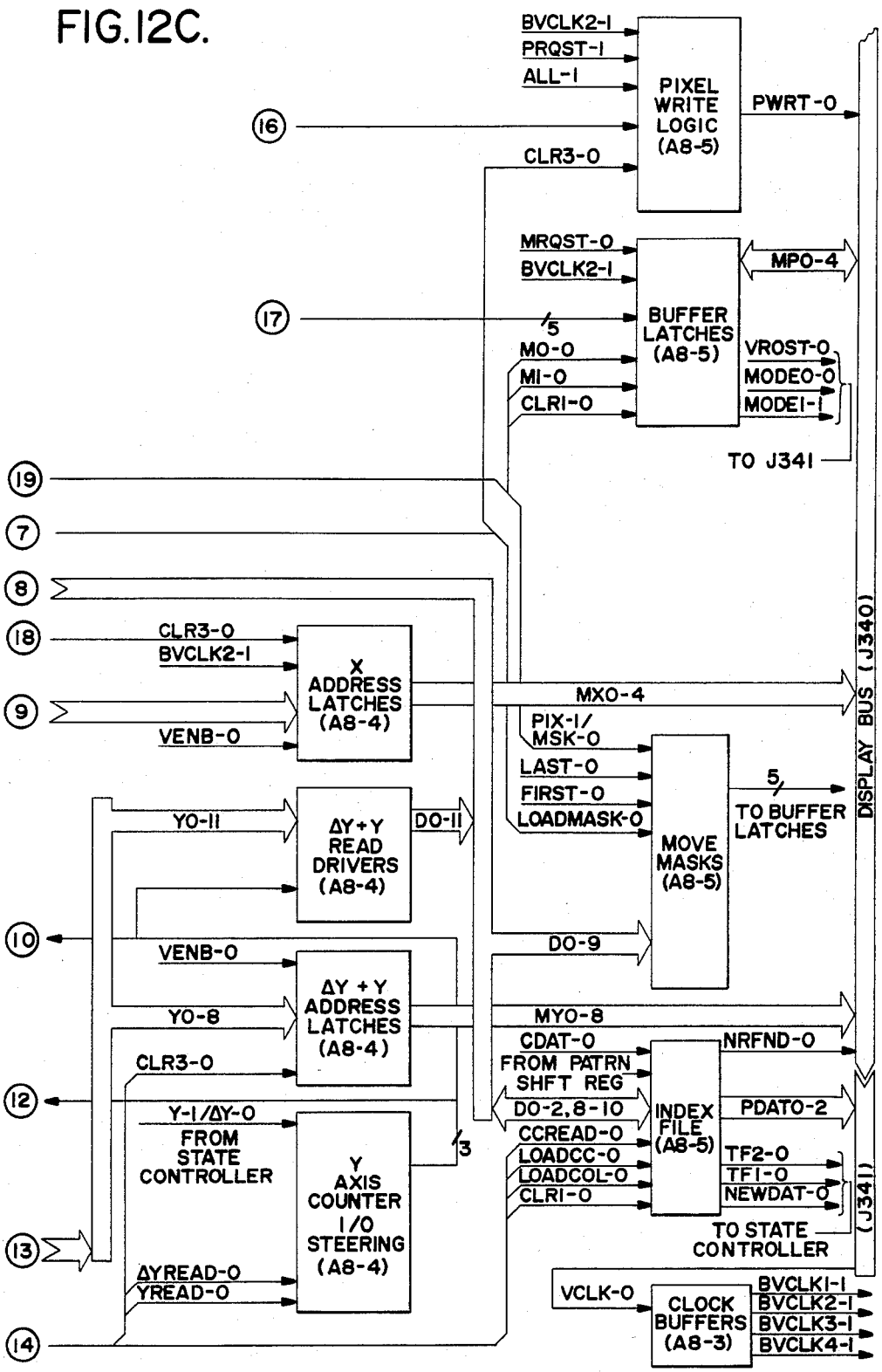

FIG. 12 is a detailed block diagram of the vector generator 18 shown in FIG. 8.

Figure 13:
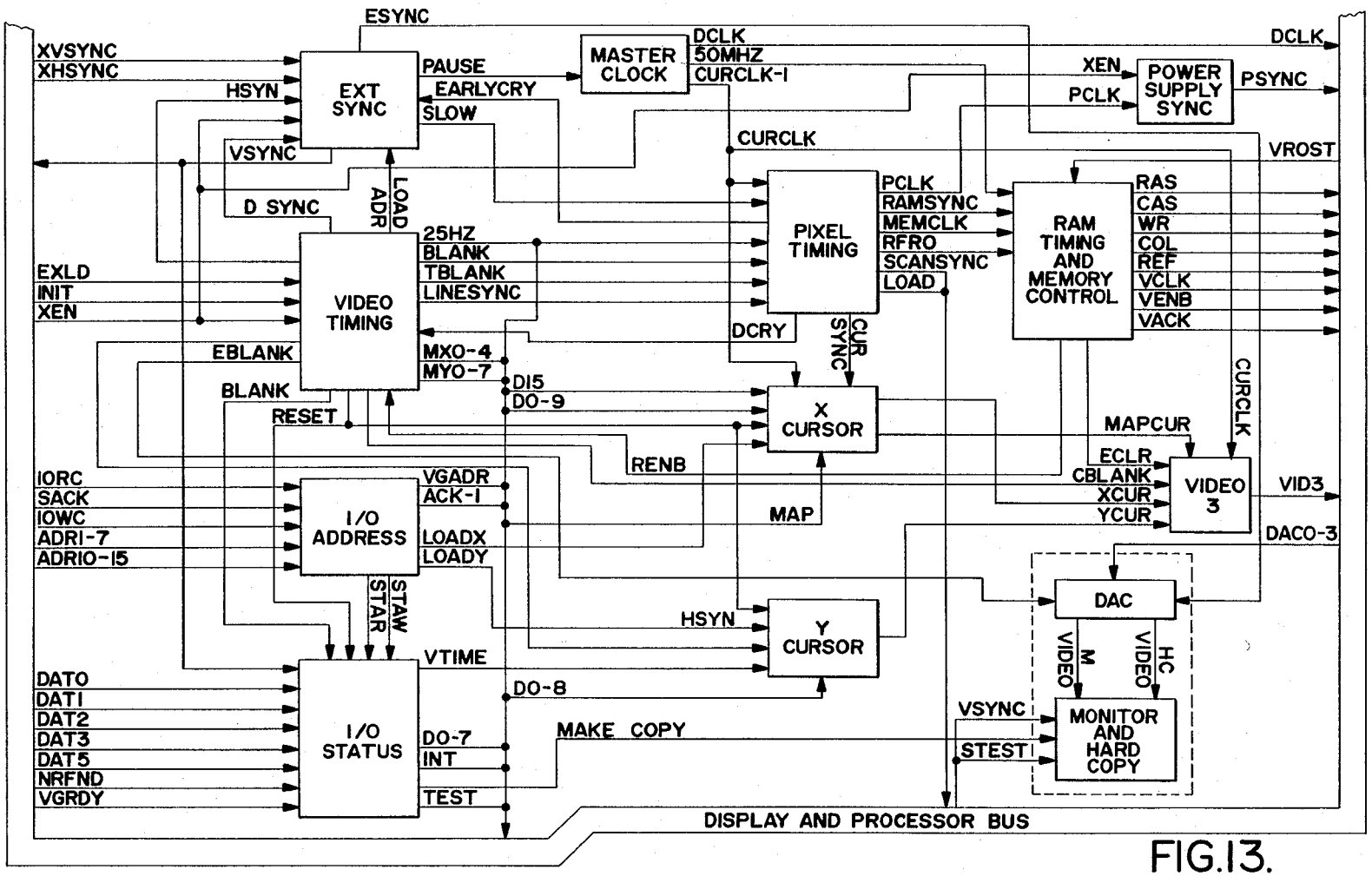
FIG. 13 is a system block diagram of the video timing control circuit shown in FIG. 8.

FIG. 13 is a detailed block diagram of the video timing and control circuit 16 shown in FIG. 8.

The firmware stored in the ROM of processor 12 of FIG. 8 is characterized by the following algorithm: Note: Whenever the word "gray" appears in the following algorithm, it means "gray or color."Let n be the number of planes in the terminal. The maximum number of surfaces that are allowed is n. At least one surface is defined at all times. If k surfaces are defined ($k<=n$), then at that time the following occurs;

(1) Surfaces O through k-1 are set visible.

(2) If $k<n$, then surfaces k through n-1 are set invisible.

(3) Surface O is set to priority O, surface 1 to priority 1, . . . , surface n-1 is set to priority n-1.

(4) The bit planes for each surface are assigned and are indicated by the arrays PlaneShiftTab and MaxGrayIndexTab defined below.

If k surfaces are defined, then only surfaces O through k-1 may have their visibilities changed through the Set-Surface-Visibility command or their priorities changed through the Set-Surface-Priority command. Therefore any undefined surfaces (surface k through surface n-1) will always be invisible and have the lowest priorities. The arrays PrioritySurfaceTab, SurfaceVisibilityTab, PlaneShiftTab and MaxGrayIndexTab all have n elements.

| | |
|---|---|
| PrioritySurfaceTab[i] = | surface number associated with priority i 0 ≦ i ≦ [n−1] |
| For example, | |
| PrioritySurfaceTab[0] = | highest priority surface number, that is, the number of the surface which is in front of all surfaces. |
| PrioritySurfaceTab[n−1] = | lowest priority surface member, that is, the number of the surface which is behind all surfaces. |
| SurfaceVisibilityTab[i] = | 1 if surface i is visible. |
| = | 0 if surface is invisible. |
| PlaneShiftTab[i] = | number of bit planes behind the bit planes constituting surface i. |
| MaxGrayIndexTab[i] = | maximum index that can be used in surface i, that is, if surface i has m planes then the maximum index is 2**m−1. |

Notice that the bit pattern represented by the quantity ShiftLeft(MaxGrayIndexTab[i], PlaneShiftTab[i]) represents a mask for surface i because each bit position in the quantity that contains a 1 corresponds to the bit position of a plane associated with surface i and each bit position in the quantity that contains a 0 corresponds to the bit position of a plane not associated with surface 1. The array GrayLevelTab can be thought of as a 2 dimensional array of size n by 2**n-1 such that: GrayLevelTab[i,j]=graylevel to be associated with the index j on the surface i.

(In reality , it is in a compressed format to save memory space.)

The variable BackGrayLevel contains the graylevel that is to be seen behind all surfaces. For any terminal, there is a function that translates the requested graylevel into the appropriate hardware gun level. We will name that function GrayLevelToGunLevel The array HWgrayTab has 2**n elements.

HWgrayTab[i]=the hardware gun level to be used whenever an n-bit pixel has the binary value i.

The algorithm uses the SurfaceVisibilityTab, SurfacePriorityTab and GrayLevelTab arrays along with BackGrayLevel to produce the appropriate values for the HWgrayTab array so that it appears to the user that the surfaces which are specified as being visible appear to be arranged with the priority given.

```
For FullIndex: =                2**n−1 to 0 do
GrayLevel: =                    BackGrayLevel
For Priority: =                 n−1 to 0 do
Surface: =                      PrioritySurfaceTab[Priority]
If SurfaceVisibilityTab[Surface] =  1 then
Index: =                        AND(SHIFTRight(FullIndex,PlaneShiftTab[Surface]),MaxGrayIndexTab[Surface])
If Index                        0 then
Graylevel: =                    GrayLevelTab[Surface, Index]
End-If
End-If
```

-continued

```
End-For
HWgrayTab[FullIndex]: =         GrayLevelToGunLevel
End-For                         (GrayLevel)
```

As can be seen from the foregoing description, the ALU control circuit 20A is mainly responsible for enabling the selection of one or more bit planes as constituting a surface. Since the user can select more than one surface, and more than one bit plane for each surface, it is possible to produce multiple number of composite images for display on the CRT. Since the firmware is capable of recomputing the color map memory, the user is thereby capable of designating one or more of the selected surfaces as being a priority surface over any of the other surfaces. In doing so, the image displayed on the CRT associated with the priority surface can be viewed as overlaying or being in front of the images displayed on the CRT associated with the other non-priority surfaces. In addition, due to the firmware's ability to recompute the color map (i.e., change brightness indices), the user is thereby capable of rendering invisible any of the other images on the CRT (associated with other "surfaces") so that a single image may appear on the CRT, independently of the others.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim as my invention:

1. Graphic display apparatus for producing a plurality of images to be independently displayed and for superimposing said plurality of images onto one another to produce a composite image on a display, comprising:

a plurality of individual storage area means, each of said storage area means storing a plurality of bits therein, each corresponding bit in each of the plurality of storage are means being associated with a pixel point on said display;

first interactive means for user subdivision of said plurality of storage area means into a plurality of groups of storage areas and for user designation of at least one of said groups to be displayed to form a composite image, each group of storage areas corresponding to an image, the number of said plurality of groups of storage areas corresponding to the maximum number of said plurality of images which may be displayed on said display, the digital condition of the bits in each of said plurality of groups of storage areas defining the particular image stored therein;

further storage means for storing a plurality of initial brightness indices therein for each of said plurality of groups of storage areas, each of the initial brightness indices determining the brightness of the image of the corresponding storage area group, said further storage means storing a plurality of columns of bits therein, the number of columns of bits corresponding to the number of groups of storage areas, each of said initial brightness indices corresponding to at least one bit in each of the plurality of columns;

scanning means for scanning said plurality of groups of storage areas to determine the digital condition of the bits in each of said plurality of groups for each pixel point on said display, the located bit in each group being representative of the image from that group to be displayed at the selected pixel point;

locating means responsive to the scanning performed by the scanning mean for locating at least one bit in each of the plurality of columns of bits in said further storage means corresponding to the located bit in each of said plurality of groups of storage areas, the locating mean determining a said initial brightness index corresponding to the located bits in each of the plurality of columns of bits in said further storage means; and means for converting the initial brightness index determined by the locating means into an electrical signal, said electrical signal determining the brightness of said composite image at each of the pixel points on said display.

2. Graphic display apparatus of claim 1 further comprising:

changing means responsive to the number of said plurality of groups of storage areas selected via the first interactive means for changing the number of said plurality of columns of bits in said further storage means and for changing the bit combinations in each column to correspond to the selected number of said plurality of groups of storage areas and to the number of individual storage area means in each group of storage area.

3. Graphic display apparatus of claim 2 wherein:

the apparatus further includes second interactive means for user designation of priority among the images of the plurality of groups of storage areas, said images appearing to overlap each other on said display in response to the priority designation; and the changing means further changes selected ones of the initial brightness indices of the plurality of groups of storage areas in response to the user priority designation.

* * * * *